United States Patent [19]

Dick

[11] 4,203,110

[45] May 13, 1980

[54] MICROWAVE PROXIMITY FUZE REQUIRING NO WARM-UP TIME AFTER BEING ACTIVATED

[75] Inventor: John O. Dick, Riverside, Calif.

[73] Assignee: The United States of America as represented by the Secretary of the Navy, Washington, D.C.

[21] Appl. No.: 265,022

[22] Filed: Mar. 12, 1963

[51] Int. Cl.[2] ..... F42C 13/04

[52] U.S. Cl. ..... 343/7 PF; 102/214

[58] Field of Search ..... 343/14, 7, 5, 12 MD, 343/7 PF; 102/70.2, 70.2 P, 214

[56] References Cited

U.S. PATENT DOCUMENTS 3,905,298 9/1975 Rehbock ..... 343/7 PF X

*Primary Examiner*—T. H. Tubbesing

*Attorney, Agent, or Firm*—Richard S. Sciascia; Joseph M. St. Amand; T. M. Phillips

EXEMPLARY CLAIM

1. In a microwave proximity fuze that can be activated within a few milliseconds prior to intercept of a target, the combination comprising:

(a) a semiconductor frequency modulated microwave generator including a transistor power amplifier, (b) a power supply for supplying B+ voltage to said power amplifier, (c) a silicon controlled rectifier switch connected in series between said power supply and said power amplifier and having its control electrode connected to a terminal adapted to be connected to a control arming signal source, (d) bias circuit means connected to said rectifier switch for maintaining a bias voltage sufficient to keep said switch in a non-conducting condition until an arming signal with sufficient voltage to overcome said bias voltage is applied to said switch.

3 Claims, 2 Drawing Figures

MICROWAVE PROXIMITY FUZE REQUIRING NO WARM-UP TIME AFTER BEING ACTIVATED

The invention herein described may be manufactured and used by or for the Government of the United States of America for governmental purposes without the payment of any royalties thereon or therefor.

The present invention relates to a microwave proximity fuze and more particularly to a microwave proximity fuze having a solid state microwave generator.

At the present time, fuzing systems employ a transmitter, a receiver, and suitable signal processing circuitry to produce, at the optimum time, a signal designed to detonate a warhead. In general the transmitter employs as the microwave generator a klystron, magnetron or other suitable microwave vacuum tube. The inherent noise of the klystron and magnetron is well known and necessitates the use of balanced mixers or other complex and expensive types of mixers with matched diodes, etc., to obtain a usable noise figure for the receiver.

The present invention substitutes a completely semiconductor microwave generator as the transmitter. By amplifying the output of a stable transistor oscillator (100 MC) and then multiplying up to the desired frequency in successive multiplier stages, greater efficiency is obtained. This increased efficiency of the complete system will permit operation by the use of a small battery of the thermal or ammonia type. Also, this increases countermeasures protection since the fuze need transmit for only a small fraction of a second, thus, the probability of jamming or dudding is greatly reduced. Accordingly an object of the present invention is to provide an improved microwave proximity fuze system which overcomes the disadvantages of known systems pointed out above.

Figure 1A:
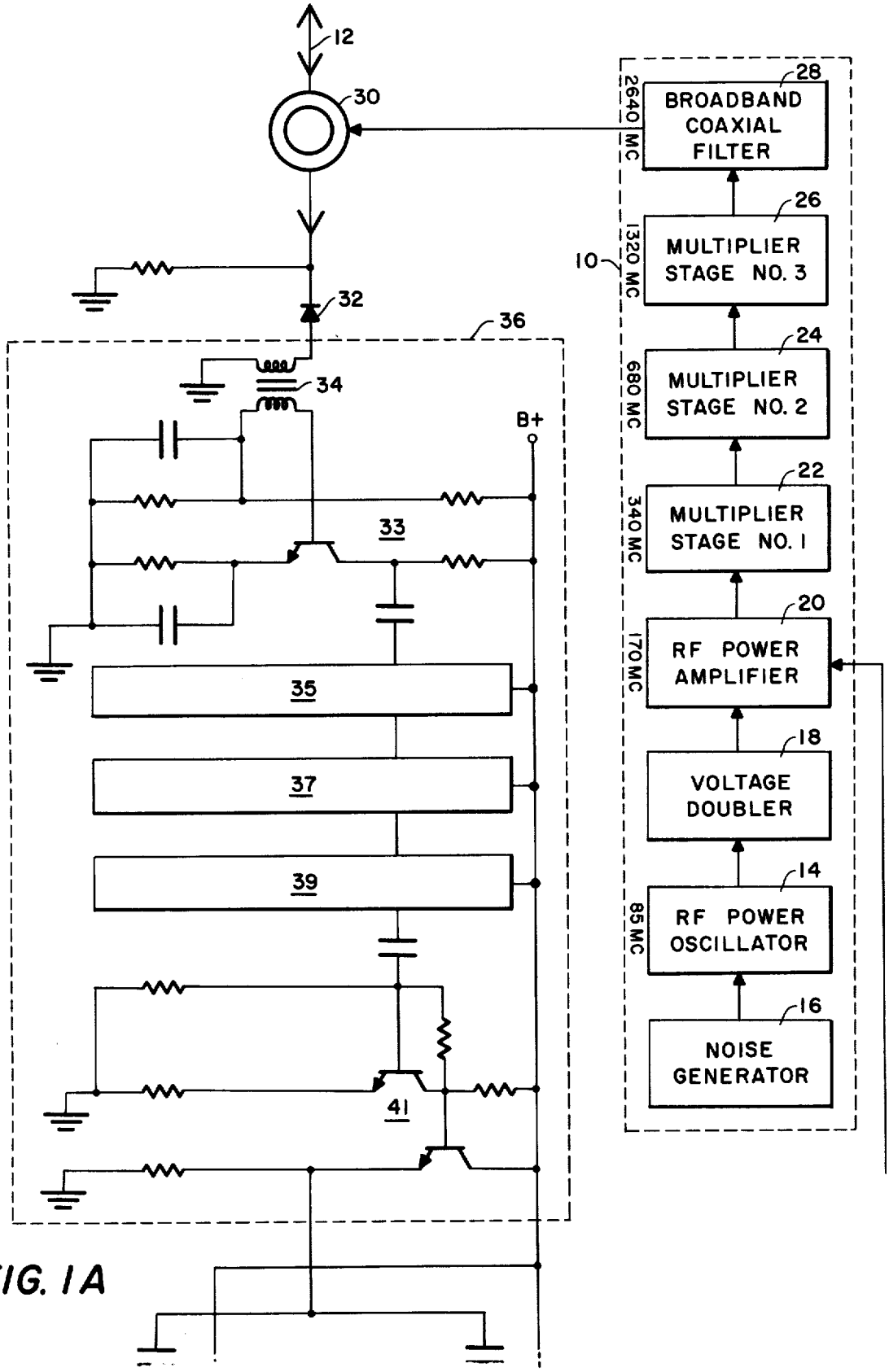
Figure 1B:
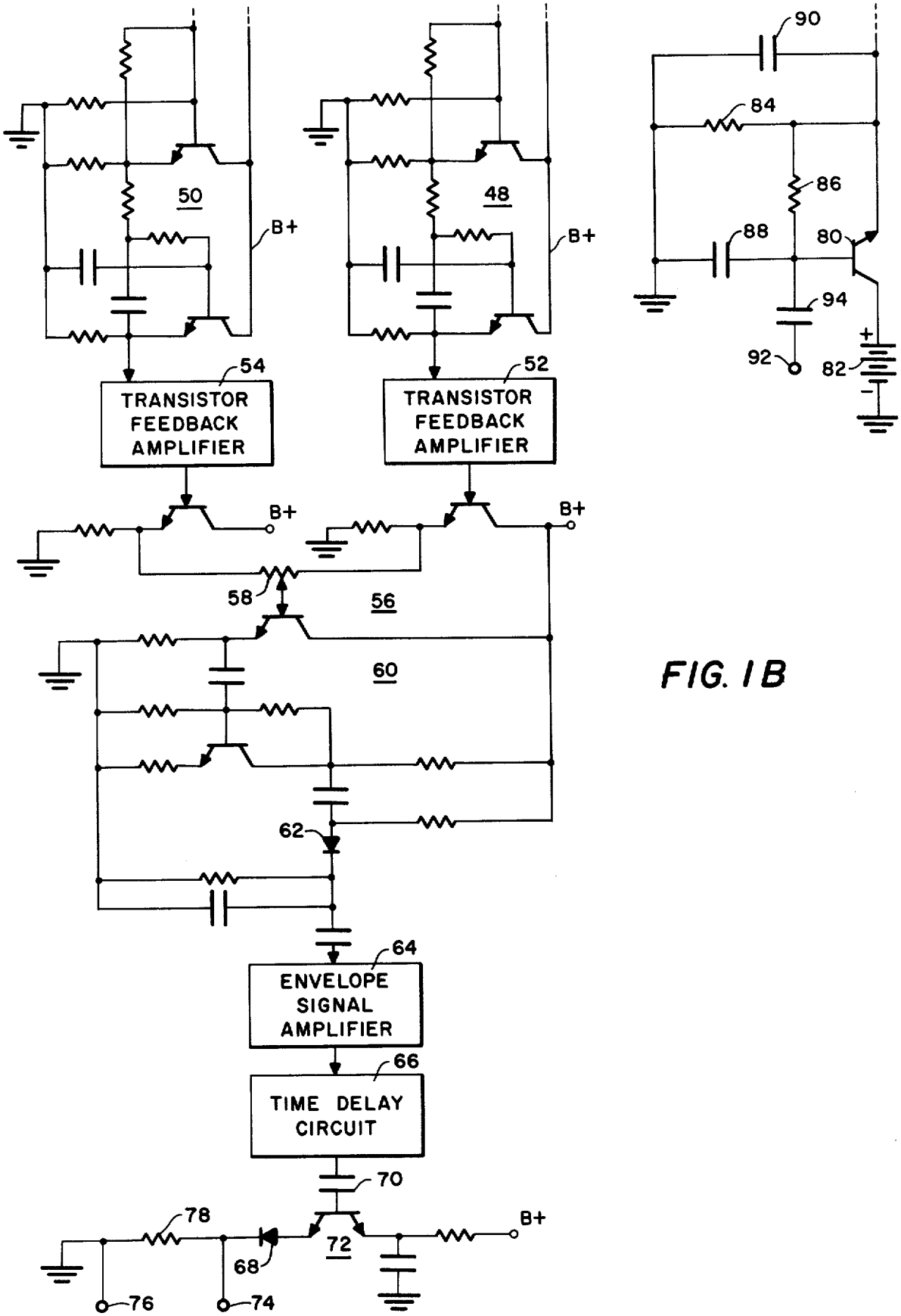

Other objects and many of the attendant advantages of this invention will become readily appreciated as the same becomes better understood by reference to the following detailed description when considered in connection with the accompanying drawings wherein there is shown in the single diagram a preferred embodiment of the invention; but for purposes of convenience, the two sheets of drawings are referred to as FIG. 1A and FIG. 1B.

Transmitter 10 is frequency modulated and provides an output of from 100 to 500 mv of "S" band power to transmitting antenna 12. RF energy is supplied for transmitter 10 by crystal controlled RF transistor power oscillator 14 which is frequency modulated by the output from noise or waveform generator 16. The output waveform from oscillator 14 is coupled to voltage doubler 18 which includes a nonlinear element to generate harmonics of the input fundamental waveform, fo. The second harmonic, 2fo, is selected by means of an L-C tuned circuit and coupled into RF power amplifier 20 which amplifies the signal, 2fo, to an output level of from 2 to 5 watts. Amplifier 20 may be a plurality of parallel connected power transistors to produce the power required. The output from amplifier 20 is progressively multiplied in multiplier stages 22, 24 and 26. The output from multiplier stage 26 is fed into broadband coaxial filter 28 which may comprise a miniature dual broadband coaxial cavity filter with the energy coupled in through a varicap diode and tuned loop. The output power from filter 28, now at Nfo, is coupled into stripline "y" circulator 30 which feeds the bulk of power to antenna 12, a stripline array, where it is transmitted.

The return signal which is reflected from any moving target to be detected is received by antenna 12 which is the same as the transmitting antenna or may be a separate receiving antenna. The reflected signal is received as an RF waveform of the same frequency, Nfo, as the transmitted wave, Nfo; but due to the phase delay introduced by the transit time of the transmitted waveform now includes a doppler frequency produced by the relative motion of the target, the signal will now have a frequency (Nfo+Δf). The resultant signal is detected in diode 32. The waveform, Nfo, when detected by diode 32 will produce a constant direct current output but the signal frequency, Δf, will be coupled by coupling transformer 34 as the input to doppler amplifier 36.

Doppler amplifier 36, preferrably, is an audio transistor amplifier capable of amplifying the minimum level of detected signals from detector 32 to a suitable level to activate the signal processing circuitry and produces an output firing pulse at the desired time after intercept. In the preferred embodiment, the minimum signal level is approximately 100 microvolts. A gain of 86 db or 20,000 will produce the desired output signal of 2 volts peak to peak. As shown in FIG. 1A, doppler amplifier 36 is made up of a plurality of amplifier stages 33, 35, 37, 39 and 41 which operate in the conventional manner.

The output signal from amplifier 36 is coupled to active band pass filters 48 and 50 which provide no gain but produce filtering with signal rejection of 40 db/decade beyond the desired pass band. Filters 48 and 50 divide the input signal into two discrete frequency bands. Filter 48 passes a band from approximately 2 KC to 10 KC and filter 50 passes a band from 10 KC to 40 KC. The outputs of filters 48 and 50 are amplified in conventional transistor feedback amplifiers 52 and 54 respectively. The amplified output signals from amplifiers 52 and 54 are added out of phase in resistive network 56 to eliminate undesired frequency components of the signal received at antenna 12. To provide the necessary phase reversal, a phase reversal stage may be included in transistor feedback amplifier 52. The resultant signal is picked off adding resistor 58 and amplified in the conventional manner in transistor amplifier 60 and detected by biased detector 62 to recover the signal envelope. The output from detector 62 is amplified in amplifier 64 and is coupled through a time delay circuit 66 to a low impedance, high energy silicon controlled rectifier 68 for generating a firing signal which is used to initiate firing of the missile warhead (not shown). Rectifier 68 is controlled by the signal from amplifier 66 coupled through coupling capacitor 70 to the base of transistor 72. The firing signal appears at terminals 74 and 76 across load resistor 78.

The activation of the transmitter is delayed until a few milliseconds prior to target intercept in order to reduce the possibility of the target of an enemy station taking countermeasures action. This is accomplished by means of silicon controlled rectifier 80 which is normally open. In the open condition, B+ from battery 82 is not applied to RF power amplifier 20. The proper bias is maintained for rectifier 80 by means of a biasing network consisting of resistors 84, 86 and capacitors 88, 90. When an arming pulse is received at terminal 92 from the missile guidance system and is applied to rectifier 80 through capacitor 94, B+ voltage is applied to amplifier 20 and the system is in active operation. Voltage build-up time should be chosen to be approximately one millisecond. This time is sufficient that transients will not be produced in the RF circuitry nor in the signal processing circuits.

Obviously many modifications and variations of the present invention are possible in the light of the above teachings. It is therefore to be understood that within the scope of the appended claims the invention may be practiced otherwise than as specifically described.

What is claimed is:

1. In a microwave proximity fuze that can be activated within a few milliseconds prior to intercept of a target, the combination comprising:

(a) a semiconductor frequency modulated microwave generator including a transistor power amplifier, (b) a power supply for supplying B+ voltage to said power amplifier, (c) a silicon controlled rectifier switch connected in series between said power supply and said power amplifier, and having its control electrode connected to a terminal adapted to be connected to a control arming signal source, (d) bias circuit means connected to said rectifier switch for maintaining a bias voltage sufficient to keep said switch in a non-conducting condition until an arming signal with sufficient voltage to overcome said bias voltage is applied to said switch.

2. A microwave proximity fuze system for use in a guided missile comprising:

(a) a solid state frequency modulated microwave generator for providing an output signal to be transmitted to a target, (b) a transmitting and receiving antenna coupled to said generator, (c) circuit means coupled to said antenna for processing reflected signals received from a target to produce a firing pulse, (d) a power supply for supplying B+ voltage to said frequency generator, (e) a silicon controlled rectifier switch connected in series between said power supply and said frequency generator, and having its control electrode connected to a terminal adapted to be connected to a control arming signal source (f) circuit means associated with said rectifier switch for activating said frequency generator by causing said rectifier switch to conduct when an arming signal is applied thereto.

3. The system of claim 2 wherein said frequency generator comprises:

(a) a noise modulated oscillator for producing an output frequency, fo, (b) a frequency doubler circuit coupled to said oscillator for doubling said output frequency, (c) a power amplifier coupled to said doubler circuit for amplifying the amplitude of said frequency doubled output, (d) a plurality of successive frequency doubler circuits for multiplying said output signal to a desired frequency Nfo, and, (e) circuit means for coupling said multiplied signal to said antenna.

* * * * *